United States Patent [19]

Marcuson et al.

[11] Patent Number: 4,830,667

[45] Date of Patent: May 16, 1989

[54] PYROMETALLURGICAL COPPER REFINING

[75] Inventors: Samuel W. Marcuson; Carlos M. Diaz, both of Mississauga; James A. E. Bell, Oakville; Haydn Davies, Sudbury; Richard Stratton-Crawley, Port Colborne, all of Canada

[73] Assignee: Inco Limited, Toronto, Canada

[21] Appl. No.: 169,284

[22] Filed: Mar. 17, 1988

[30] Foreign Application Priority Data

Mar. 23, 1987 [CA] Canada ..... 532721

[51] Int. Cl.[4] ..... C22B 15/00

[52] U.S. Cl. ..... 75/76; 75/93 E

[58] Field of Search ..... 75/76, 93 E

[56] References Cited

U.S. PATENT DOCUMENTS

| | | | |
|---|---|---|---|
| 4,073,646 | 2/1978 | Kryczun | 75/76 |
| 4,469,513 | 9/1984 | Staib | 75/76 |
| 4,614,542 | 9/1986 | Kimura | 75/76 |
| 4,699,656 | 10/1987 | Mantymaki | 75/93 E |

*Primary Examiner*—Peter D. Rosenberg

*Attorney, Agent, or Firm*—Raymond J. Kenny; Francis J. Mulligan, Jr.

[57] ABSTRACT

A copper converting process starting with white metal or a mixture of white metal and metallic copper in which oxidizing gas contacts the molten copper mass either at or near the top surface of the molten mass while the mass is sparged with an inert gas from at or near the bottom of the mass and sparging is continued after contact with the oxidizing gas ceases.

9 Claims, No Drawings

PYROMETALLURGICAL COPPER REFINING

The present invention relates to the field of pyrometallurgical production of blister and/or refined copper from sulfide ores, concentrates, and/or secondary sources. More specifically, it relates to the efficient conversion of copper containing significant amounts of sulfur, e.g. up to about 20%, into copper metal having a sulfur content less than about 0.1% or even less than 0.01% and a low content of impurities amenable to oxidation.

STATEMENT OF PRIOR ART AND PROBLEM

In conventional, batch converting of copper mattes (essentially a solution containing variable amounts of $Cu_2S$ and FeS and minor amounts of oxygen and other elements) produced in primary copper smelting units, finishing to blister is the last of several converting stages which are normally conducted in the same vessel (side blown converters—Pierce Smith, Hoboken, etc.—or Top Blown Rotary Converters [TBRC's]). These stages can be identified as:

(1) slagging, which involves the elimination of iron as iron oxides which are slagged with a flux, until the melt left in the converter consists essentially of white metal (predominantly $Cu_2S$);

(2) conversion of the white metal to semiblister (white metal and semiblister are immiscible) until complete disappearance of the white metal; and (3) production of blister by elimination of the sulfur in the semiblister melt down to levels acceptable for further processing of the copper in anode furnaces. In some cases, the last converting stage entails the elimination of residual impurities which are undesirable in the anode furnace. This is the case of nickel when the content of this element in copper exceeds levels of about 1%.

Since it is impossible to completely skim all slag from a converter, blowing white metal to semiblister and eventually to blister is conducted in the presence of slag left in the converter from the slagging operation. In the final stage of conversion, i.e. elimination of sulfur from semiblister, there is a steep increase in the system's oxygen potential which causes the gradual stiffening of the slag layer. This phenomenon is aggravated in conversion of nickel-contaminated copper in the presence of siliceous slags because siliceous slags have a low solubility for the high melting point nickel oxide which is formed during nickel elimination. In addition, agitation of the bath in side-blown converters operated at normal blowing pressure, i.e. about 2 atmospheres (absolute), and in TBRC's is far from optimal. Accordingly, the bath is normally not at equilibrium and excessive copper oxidation occurs while attempting to achieve the sulfur target and/or eliminate undesirable elements, e.g. nickel. Copper oxide becomes entrained in the mushy slag thus severely limiting the probability that it can back-react with the still unfinished melt. When blister is finally cast, a large amount of "mush", consisting mainly of iron, copper and other oxides, e.g. nickel oxide, is left in the converter. This mush must be digested by furnace matte at the start of the next converting cycle, and this imposes limitations on the grade of furnace matte which can be produced. Furthermore, the addition of furnace matte to a converter loaded with "mush" causes the evolution of substantial amounts of $SO_2$ which in turn causes serious workplace environmental problems.

Conversion of copper containing more than about 1% nickel presents a special problem. The nickel content in the blister has to be lowered to less than 1% to yield acceptable anode grade copper. The nickel eliminated from the copper concentrates in the mush. Periodic disposition of this mush is required in order to avoid accumulation of nickel in the converting vessel. Minimizing the amount of copper oxide formed in the last stage of converting which reports to the mush is particularly important for maximizing copper recovery.

The final stage of converting in side-blown vessels, i.e. finishing semiblister to blister, is also characterized by a substantial loss in oxygen efficiency. This is due not only to the far from optimal agitation but also to the usually shallower position of the tuyeres with respect to the surface of the bath. Oxygen efficiencies in this stage are only about 50%.

Most of these problems can be solved by transferring white metal or semiblister, with or without white metal, to another vessel where the final stages of converting can be conducted closer to equilibrium, thus minimizing the formation of copper oxide and/or, in some cases of mushy oxidic precipitates. This possibility is particularly open to products of one-step smelting processes and/or continuous conversion vessels in which semiblister and/or white metal are obtained.

Applicants are aware that in U.S. Pat. No. 4,469,513 it is disclosed that top blowing of copper melts can be accompanied by sparging the melt from the bottom.

OBJECT AND GENERAL STATEMENT OF THE INVENTION

It is an object of the invention to provide an improved means of blowing molten white metal or semiblister copper to blister copper by top or side blowing with an oxygen-containing gas while bottom sparging the molten mass with an essentially inert (non-reactive) gas and continuing sparging after blowing with the oxygen-containing gas is discontinued. The sparging agitates the bath enhancing the elimination of sulfur and undesirable minor elements, increases oxygen efficiency and prevents the formation of excessive amounts of copper oxide.

DESCRIPTION OF THE INVENTION

The present invention contemplates a process for removing sulfur from a molten copper mass containing a sulfur content in an amount up to equivalent to that of $Cu_2S$, nickel in an amount up to about 5%, the remainder being essentially copper and associated impurities comprising: (a) contacting said molten copper mass with a gas containing oxygen at a point or points above about the midpoint of depth of said molten copper mass until the copper mass contains sufficient oxygen to meet the sulfur specification of the product; while (b) sparging said molten copper mass with a gas from a point significantly below the midpoint of depth of said molten copper mass; and (c) continuing said sparging with an inert gas after contact between said molten copper mass and the gas containing oxygen ceases.

The aforementioned molten copper mass is usually white metal or semiblister copper or a mixture of both obtained from primary sources (ores or ore concentrates) but can comprise or include copper from any source. The molten copper mass is confined in. any suitable vessel. Advantageously, contact of the molten copper mass with a gas containing oxygen is achieved by top-blowing the molten mass with air, oxygen-enriched air or oxygen and the entire sparging is accomplished with an inert gas, e.g nitrogen or argon, from a point at or close to the bottom of the molten copper mass.

According to a more advantageous embodiment of the present invention, melts consisting of semiblister, white metal or mixtures of the two are converted to copper containing less than 100 ppm S by means of top blowing oxidizing gas onto the melt while simultaneously sparging with inert gas and continuing sparging after top blowing ceases. Sparging agitates the bath causing enhancement of elimination of sulfur as well as of impurities, an increase in oxygen efficiency, and prevention of formation of excessive amounts of copper oxide.

This invention is particularly useful in the finishing to blister of semiblister and/or white metal contaminated with up to about 5% nickel. In this case, desulfurization to low levels can be achieved while avoiding excessive formation of a nickel-copper oxidic mush. Initially the molten copper is in contact with an oxygen-containing gas while being stirred by sparging with inert gas. When sufficient oxygen has built up in the system so that the sulfur specification can be met, advantage accrues by stopping the blow and simply stirring the bath by sparging for an additional period. The oxygen in the system causes exsolution of most of the nickel as nickel oxide when the stirred melt is cooled to temperatures comfortably above the liquidus at which the melt has sufficient superheat for casting and transfer to another vessel. The practice of these successive stages, i.e. oxidizing with stirring and then stirring alone can yield blister copper containing about 100 ppm S and about 1% Ni.

Inert gas sparging of the melt while converting by top blowing enhances the approach to equilibrium and improves oxygen efficiency. Moreover, stirring is conducted independently of blowing. Therefore, it becomes possible to bring the system to equilibrium by simple stirring if excessive copper oxidation is observed.

More specifically, thermodynamic measurements, estimates, and calculations on the Cu-Ni-S system have shown that at conventional conversion temperatures sulfur oxidation is strongly favored with respect to both nickel and copper oxidation. This means that it is possible to convert blister copper to the 100 ppm S level without oxidizing significant amounts of nickel or copper if large deviations from equilibrium conditions can be avoided. Thus significant improvements in converting metallurgy of nickel-containing semiblister and/or white metal are possible using the process of the present invention.

In comparison with copper refining processes of the prior art, the following advantages are achieved with the presently disclosed process:

1. Agitation of the bath promotes the reaction between gas and melt keeping the system close to equilibrium. This allows sulfur oxidation to proceed before significant amounts of copper and nickel (if present) are oxidized.

2. Most advantageously, in a preferred aspect of the present invention, oxidizing gases are not blown through submerged tuyeres but instead are top blown. As a result, the oxygen content of the oxidizing gas is independent of restrictions imposed by tuyere wear.

3. The sparging of non-reactive gas simultaneously with blowing of oxidizing gas increases the oxygen efficiency of the top blown gases.

4. The process allows separate control of oxidative blowing and agitation. Thus, when sufficient oxygen has built up in the bath, top blowing is stopped and sparging continued to effect sulfur removal and elimination of impurities to targeted levels while minimizing copper oxide formation.

5. The process can take advantage of any suitable means of gas sparging such as submerged lances, conventional tuyeres as used in a number of converting operations, porous plugs as commonly used in the steel industry, or high pressure, punchless injectors currently being developed.

This invention is applicable for the treatment of copper from either primary or secondary sources, and may be used as the last stage in copper converting. This invention is also applicable to the oxidative (first) stage of fire refining blister copper, which usually characterizes anode furnace operation.

EXAMPLE I

Three tonnes of copper assaying 3.1% nickel and 1.2% sulfur were melted using an oxy-fuel burner in a ladle into the bottom of which had been installed a porous ceramic plug. The temperature of the melt was adjusted to 1300° C. Nitrogen was blown through the plug at 40 liters/minute during meltdown and blowing. To effect conversion, air was blown at 10 $m^3$/minute through a 3.8 cm diameter schedule 40 pipe suspended 51 cm above the eye in the bath formed by the nitrogen sparging. The fuel consumption rate was adjusted to offset heat losses and maintain a bath temperature of about 1300° C. After 30 minutes of blowing, the bath assayed (wt. %): 0.023 S, 1.24 Ni, 0.67 O. Blowing was resumed for one minute after which nitrogen stirring was continued for 60 minutes while maintaining the temperature at about 1300° C. At the end of this period, the bath assayed (wt. %): 0.008 S, 1.13 Ni, 0.92 O. Then, the burner was turned off; the nitrogen rate was adjusted to 10 liters/minute, and the melt allowed to cool. After 45 minutes, the blister temperature was 1215° C., and it assayed (wt. %): 0.005 S, 0.55 Ni, 1.02 O.

Samples of mush taken at the end of cooling showed that this material contained little copper oxide so that the ratio of copper as oxide to nickel as oxide was well below one. An oxygen efficiency close to 100% was calculated based on the composition of the final bath.

EXAMPLE II

In a run similar to EXAMPLE I, three tonnes of copper assaying (wt. %): 0.7 S, 2.9 Ni, 0.1 O were blown for 20 minutes to yield a bath assaying (wt. %): 0.046 S, 1.47 Ni, 0.73 O. After sampling, blowing was continued for two additional minutes, and stirring of the bath proceeded for another 60 minutes. At this point, the bath assayed (wt. %): 1.27 Ni, 0.005 S, and 1.22 O. Temperature during the blowing and stirring periods was held at about 1300° C. Then, the bath was cooled to 1190° C. producing a blister copper containing 0.004 S, 0.55 Ni and 0.97 O and mush. Mush analyses indicated that the ratio of oxidic copper to oxidic nickel was about one to three. Oxygen efficiency was calculated at about 100%.

In the Examples given, air is the oxidizing gas and has been introduced into the molten copper bath by top blowing. Those skilled in the art will appreciate that air can be replaced with oxygen or enriched with oxygen and, provided suitable equipment is available, can be introduced below the surface of the molten copper. The sparging gas is advantageously introduced at or very near the bottom of the vessel containing the molten copper metal. However, the advantages of the invention, perhaps in diminished degree, will still be obtained if the inlet for sparging gas is spaced away from the bottom of the containing vessel but below the midpoint of the height of the molten copper in the vessel. Sparging gas is preferably commercially pure nitrogen but can contain some oxygen or other bath refining materials, or gaseous impurities. It is also possible but not necessarily desirable after cessation of contact of oxidizing gas with the molten copper and after the molten copper bath has reasonably equilibrated to employ a reducing gas with or without nitrogen. Other modifications and variations will become apparent to those of skill in the art in light of this specification and the appended claims.

The embodiments of the invention in which an exclusive property of privilege is claimed are defined as follows:

1. A process for removing sulfur from a molten copper mass containing sulfur in an amount up to the sulfur content of $Cu_2S$, up to about 5% nickel the remainder being essentially copper and associated impurities comprising:

(a) contacting said molten copper mass with a gas containing oxygen at a point or points above about the midpoint of depth of said molten copper mass until said molten copper mass contains sufficient oxygen to meet the sulfur specification of the product; while (b) sparging said molten copper mass with a gas from a point significantly below the midpoint of depth of said molten copper mass; and (c) continuing sparging with an inert gas after contact between said molten copper mass and the gas containing oxygen ceases.

2. A process as in claim 1 in which contact of said molten copper mass with a gas containing oxygen is by top blowing.

3. A process as in claim 1 wherein said gas containing oxygen is air.

4. A process as in claim 1 wherein said sparging gas in step (b) is an inert gas.

5. A process as in claim 4 wherein said inert gas contains nitrogen.

6. A process as in claim 1 wherein sparging originates at or near the bottom of said molten copper mass.

7. A process as in claim 1 wherein during the latter part of sparging with inert gas the molten copper mass is cooled whereby nickel is exsolved as nickel oxide from said molten copper mass.

8. A process as in claim 7 wherein said contact with a gas containing oxygen is by top blowing.

9. A process as in claim 8 wherein said top blown gas is air.

* * * * *